US006199459B1

(12) United States Patent
Azkona

(10) Patent No.: US 6,199,459 B1
(45) Date of Patent: Mar. 13, 2001

(54) ADJUSTABLE PLIERS

(75) Inventor: Manuel Azkona, Abadiano (ES)

(73) Assignee: Super-Ego Tools, S.A. (ES)

( * ) Notice: Subject to any disclaimer, the term of this patent is extended or adjusted under 35 U.S.C. 154(b) by 0 days.

(21) Appl. No.: 09/469,531

(22) Filed: Dec. 22, 1999

(30) Foreign Application Priority Data

May 3, 1999 (ES) ..... 9901131 U

(51) Int. Cl.[7] ..... B25B 7/04
(52) U.S. Cl. ..... 81/411; 81/413; 81/357
(58) Field of Search ..... 81/411, 412, 405, 81/407, 413, 357, 358, 341, 385

(56) References Cited

U.S. PATENT DOCUMENTS 1,867,505 * 7/1932 Graner .

5,887,495 * 3/1999 Kao .

* cited by examiner

*Primary Examiner*—D. S. Meislin

(74) *Attorney, Agent, or Firm*—Bierman, Muserlian and Lucas

(57) ABSTRACT

Improved adjustable pliers, of the kind comprised of different bodies bearing the jaws of the mouth, and which pivot together on an axle-pivot, which moves in a groove, foreseen in one of the bodies, which has monodirectional teeth on one of its larger walls, mounting a catch, on said axle-pivot foreseen in the other body, which defines combined monodirectional teeth and an operating arm to release these teeth at the user's will. This catch has a spring, whose aim is to keep it in a fastened position, until the catch arm is activated.

1 Claim, 1 Drawing Sheet

ADJUSTABLE PLIERS

Figure 1:
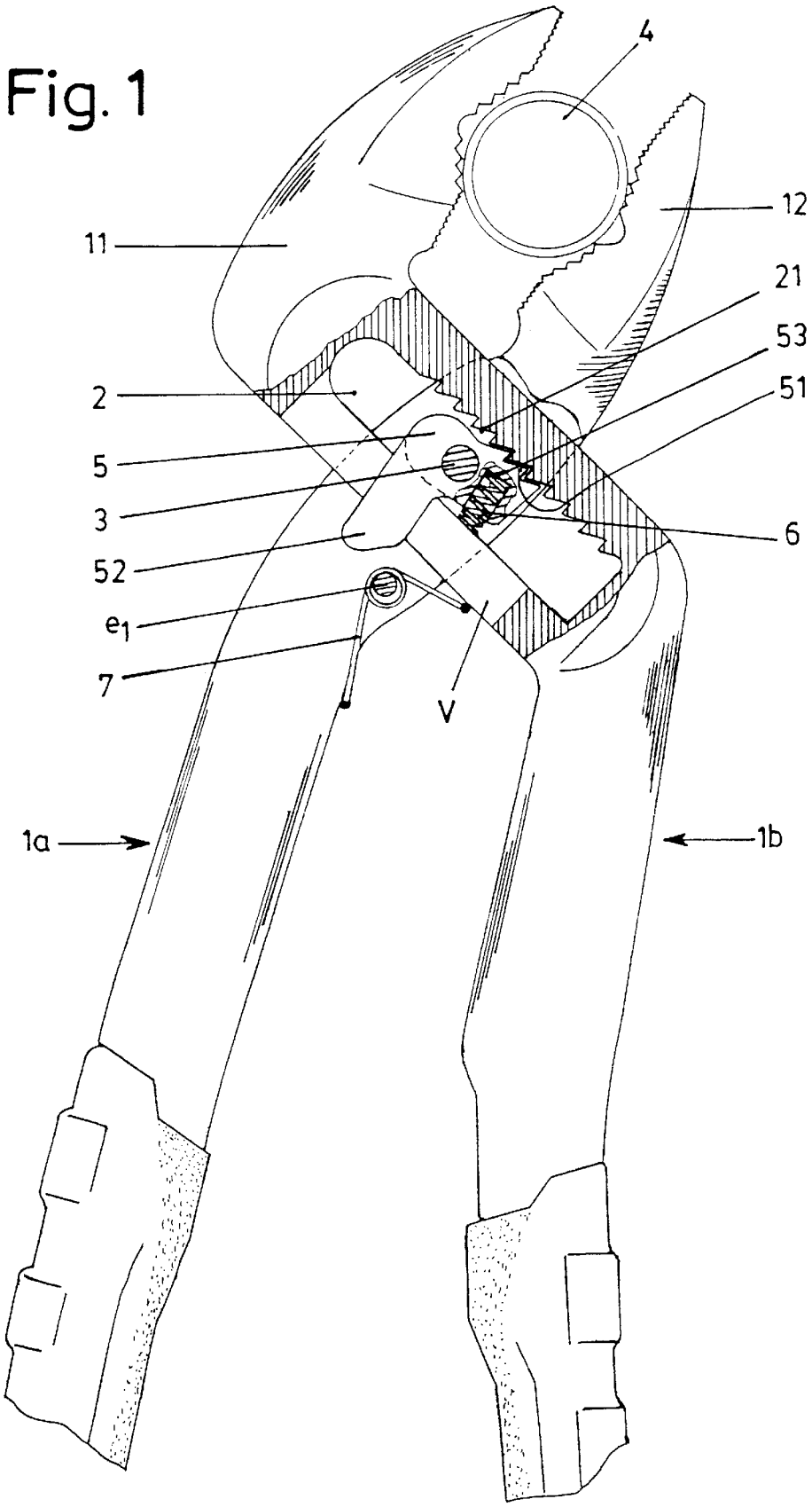

This invention deals with improved adjustable pliers.

Pliers with two bodies that pivot and slide together are already well-known.

The research has been focused, on the one hand, on the shape of the mouth and its jaws—which determine the efficiency of the pliers—and on the other, on the way to position the two bodies together—and keep them positioned—in order to determine the correct position of these bodies when gripping tubes of different diameters.

The part is gripped by the pliers with its teeth, but as different pliers cannot be manufactured for each part diameter, some pliers are manufactured, which adapt to different thicknesses or diameters, for examples of tubes, and pliers have been sought that can grip the largest number of diameters possible, especially when the diameters of the tubes corresponding to the European measurement system are slightly different from those of the US measurement system.

There are already some adjustable pliers that are comprised of two bodies that bear the mouth jaws, and which pivot together on a moveable pivot in a groove and which can be fitted into different heights of one of the bodies. Proceedings U-8900254, DE-20316561, U.S. Pat. No. 3,005,368 and U.S. Pat. No. 4,269,089, among others are mentioned as examples.

One of the problems of these adjustable pliers with traditional technology is the security of keeping the arms positioned together and releasing them easily.

The improved adjustable pliers according to the invention exceed these limitations advocating new pliers of the type described, which are characterised because:

a).—this groove, foreseen in one of the bodies, has monodirectional teeth on one of its walls;

b).—the axle-pivot, foreseen in the other body, has a catch, which defines combined monodirectional pluri-teeth and an operating arm to release these teeth at the user's will;

c).—this catch has a spring which is aimed at keeping it in a fastened position, until the arm of the catch is activated.

The pluri-toothed catch (instead of one tooth) offers the advantage of quick and secure positioning of the arms together.

The catch operating arm offers the user easy, accessible, economical and rapid control to release pluri-teeth of the catch from the pluri-teeth in the groove, or in other words, to release the arms.

In order to understand the object of this invention better, a preferential practical execution is shown on the drawings, subject to accessory changes that take nothing away from the basics.

FIG. 1 shows a general schematic view of improved adjustable pliers according to the invention, where the following references and peculiarities are written down:

1*a*, 1*b*.—Bodies.

2. Groove.

3. Axle-pivot.

4. Tube or part to be handled.

5. Catch

6, 7. Springs

11, 12. Jaws.

21, 51. Monodirectional teeth

52. Operating arm

53. Box $e_1$. Auxiliary axle.

The pliers advocated are of the type comprised of two bodies (1*a*), (1*b*), which pivot together on an axle-pivot (3) belonging to the body (1*a*) and which moves to adopt different positions on a groove (2) in the other body (1*b*).

Each body (1*a*), (1*b*) has a jaw (12), (11), which when closed, leaves an empty space where the part to be handled (4) is gripped, the union of both jaws (11), (12) forming the mouth of the pliers.

In accordance with the invention, and according to the execution shown, this groove (2) foreseen in the body (1*b*) has, on one of its larger walls, monodirectional teeth (21).

In accordance with the invention, and according to the execution shown, this axle-pivot (3) has a catch (5), it being possible to tilt it.

The catch (5) defines monodirectional (pluriteeth) teeth (51)—combined from the previous teeth (21)—and an operating arm (52) and is aimed at maintaining the teeth (21) (51) in a fastened position due to the action of a spring (6)—mounted, for example, housed in a box (53) and coming up against the actual arm (1*b*)—unless the user operates this catch (5) by operating the arm (52).

The arm (52) juts out on the outside through a window (V) made in the body (1*b*) as an extension of the groove (2).

An additional spring (7), mounted on an auxiliary axle ($e_1$) has the aim of maintaining the arms (1*a*) (1*b*) in one position until the user applies them in another position.

What is claimed is:

1. In adjustable pliers having two bodies which form a jawed mouth and pivot about an axle pivot, the axle pivot mounted on one of said bodies and the other of said bodies has a groove in which said axle pivot moves to allow for adjustment of said jawed mouth, the improvement comprising:

(a) a first set of monodirectional teeth on one long wall of said groove;

(b) a second set of monodirectional teeth on a catch, said catch rotatably mounted on said axle pivot;

(c) a spring, said spring forcing said second set of monodirectional teeth against said first set of monodirectional teeth to maintain said jawed mouth;

(d) a window in another long wall of said groove, said other long wall being opposite said one long wall in said groove; and (e) an operating arm affixed to said catch for releasing said first set of monodirectional teeth from said second set of monodirectional teeth and allow for adjustment of said jawed mouth, said operating arm extending through said window.

* * * * *